US008892434B2

(12) United States Patent
Suzuki

(10) Patent No.: US 8,892,434 B2
(45) Date of Patent: Nov. 18, 2014

(54) VOICE EMPHASIS DEVICE

(71) Applicant: Panasonic Corporation, Osaka (JP)

(72) Inventor: Ryoji Suzuki, Nara (JP)

(73) Assignee: Panasonic Corporation, Osaka (JP)

( * ) Notice: Subject to any disclaimer, the term of this patent is extended or adjusted under 35 U.S.C. 154(b) by 196 days.

(21) Appl. No.: 13/711,764

(22) Filed: Dec. 12, 2012

(65) Prior Publication Data

US 2013/0166289 A1 Jun. 27, 2013

(30) Foreign Application Priority Data

Dec. 27, 2011 (JP) ..... 2011-285012

(51) Int. Cl.
*G10L 21/0264* (2013.01)
*G10L 21/0364* (2013.01)
*G10L 25/93* (2013.01)

(52) U.S. Cl.
CPC ..... *G10L 21/0264* (2013.01); *G10L 25/93* (2013.01); *G10L 21/0364* (2013.01)
USPC ..... 704/226

(58) Field of Classification Search
CPC ..... G10L 21/0264
USPC ..... 704/226
See application file for complete search history.

(56) References Cited

FOREIGN PATENT DOCUMENTS

| | | |
|---|---|---|
| JP | 7-273599 | 10/1995 |
| JP | 2005-287600 | 10/2005 |
| JP | 2007-219188 | 8/2007 |
| JP | 2008-102551 | 5/2008 |
| JP | 2010-055022 | 3/2011 |

*Primary Examiner* — Susan McFadden
(74) *Attorney, Agent, or Firm* — Panasonic Patent Center

(57) ABSTRACT

There is provided a voice emphasis device with which voice clarity can be improved. This voice emphasis device comprises a correlation component removal filter circuit that removes a correlation component from a voice signal produced at a specific sampling frequency, a multiplication circuit that produces an extracted signal by multiplying a specific gain coefficient by the output of the correlation component removal filter circuit, and an arithmetic circuit that adds or subtracts the extracted signal to or from the voice signal. The correlation component removal filter circuit is a lattice-type filter circuit that combines a feedforward filter and a feedback filter. The feedforward filter and the feedback filter update the filter coefficient at the specific sampling frequency based on the formula $k_{i,j+1}=k_{i,j}+\alpha\times f_i/b_{i-1}$.

5 Claims, 6 Drawing Sheets

VOICE EMPHASIS DEVICE

CROSS-REFERENCE TO RELATED APPLICATIONS

This application claims priority under 35 U.S.C. §119 to Japanese Patent Application No. 2011-285012, filed on Dec. 27, 2011. The entire disclosures of Japanese Patent Applications No. 2011-285012 is hereby incorporated herein by reference.

BACKGROUND

1. Technical Field

The technology disclosed herein relates to a voice emphasis device comprising a correlation component removal filter circuit.

2. Background Information

A method has been proposed in the past for emphasizing voice sound by finding a residual signal by passing an input signal through a reverse filter formed based on a linear prediction coefficient obtained by subjecting the input signal to linear predictive coding, and then inputting the residual signal through a filter formed on the basis of a linear prediction coefficient corrected so as to emphasize formants (see Japanese Laid-Open Patent Application 2010-055022, 2005-287600 and 2007-219188). However, even if formants are emphasized by processing vowels that have a high signal level and are easy to hear, as with this method, it is difficult to improve voice clarity. Meanwhile, consonants tend to be masked by vowels because they have a lower signal level than vowels, and the frequency spectrum of consonants extends up to a high frequency, which means that people who have trouble hearing higher frequencies will have trouble hearing consonants. In view of this, a method has been proposed for improving voice clarity by amplifying or repeating a number of times those consonants extracted from voice sound by detecting a section in which the amplitude of a voice signal is at or below a specific value (see Japanese Laid-Open Patent Application 2005-287600 and 2007-219188).

SUMMARY

With the methods in Japanese Laid-Open Patent Application 2005-287600 and 2007-219188, however, it is difficult to reliably identify consonants from voice in a real environment, so voice clarity may not be improved.

It is an object of the technology disclosed herein to provide a voice emphasis device with which voice clarity can be improved.

A voice emphasis device disclosed herein comprises a correlation component removal filter circuit that removes a correlation component from a voice signal produced at a specific sampling frequency, and a voice signal processor that executes signal processing on the voice signal based on an output of the correlation component removal filter circuit. The correlation component removal filter circuit is a lattice-type filter circuit in which a feedforward filter and a feedback filter are combined. The feedforward filter and the feedback filter update the filter coefficient on the basis of the specific sampling frequency according to the formula $k_{i,j+1}=k_{i,j}+\alpha\times f_i/b_{i-1}$.

Voice clarity can be improved with the voice emphasis device disclosed herein.

DETAILED DESCRIPTION OF EMBODIMENTS

First Embodiment

Configuration of Voice Emphasis Device 100

Figure 1:
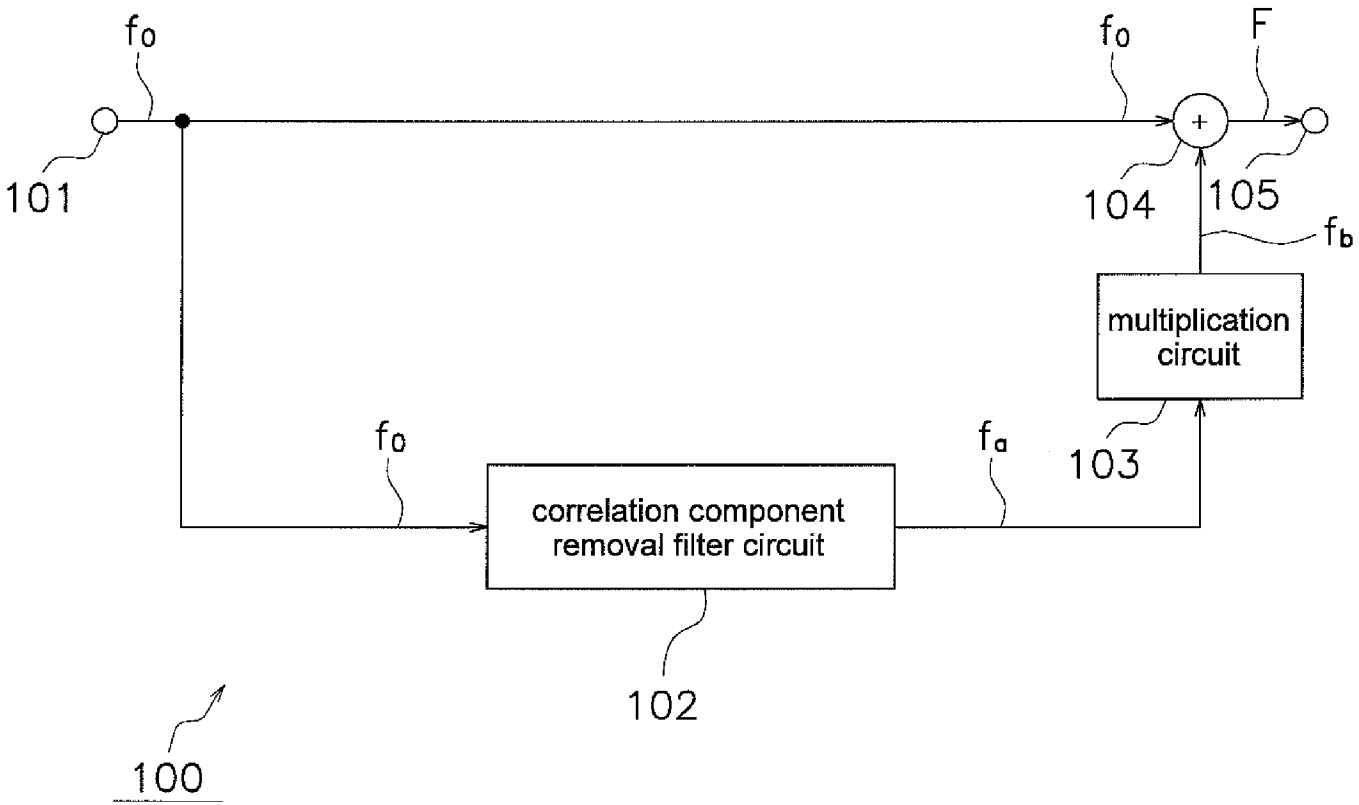
FIG. 1 is a block diagram of the configuration of the voice emphasis device pertaining to a first embodiment.

FIG. 1 is a block diagram of the configuration of the voice emphasis device 100 pertaining to a first embodiment. The voice emphasis device 100 comprises an input terminal 101, a correlation component removal filter circuit 102, a multiplication circuit 103, an arithmetic circuit 104, and an output terminal 105.

The input terminal 101 is used for inputting a voice signal $f_0$. The voice signal $f_0$ inputted from the input terminal 101 is outputted to the correlation component removal filter circuit 102 and the arithmetic circuit 104. The voice signal $f_0$ is produced by sampling at a specific sampling frequency. The sampling frequency is 44.1 kHz for a music CD, for example, and is 8 kHz for a telephone line.

The correlation component removal filter circuit 102 is a lattice-type filter circuit for removing a signal component having autocorrelation from the voice signal $f_0$ inputted from the input terminal 101. The correlation component removal filter circuit 102 extracts with no periodicity, such as consonants, other than signal components with periodicity, such as vowels (hereinafter referred to as the "feedforward predicted error signal $f_n$"). The correlation component removal filter circuit 102 outputs a filter output signal fa based on the feedforward predicted error signal $f_n$ to the multiplication circuit 103.

The multiplication circuit 103 multiplies a filter output signal fb outputted from the input terminal 101 by a gain coefficient. As a result, the filter output signal fa is increased, and an extracted signal fb is produced. In this embodiment, the gain coefficient is set to "1," but this is not the only option.

The arithmetic circuit 104 adds the extracted signal fb inputted from the multiplication circuit 103 to the voice signal $f_0$ inputted from the input terminal 101. This producers an output signal F in which the signal level of the consonant of the voice signal $f_0$ has been raised. The extent to which the consonant is emphasized in the output signal F can be adjusted by varying the gain coefficient in the multiplication circuit 103.

The multiplication circuit 103 and the arithmetic circuit 104 constitute a "voice signal processor" that executes signal processing of the voice signal $f_0$ based on the output of the correlation component removal filter circuit 102 (specifically, the filter output signal fa).

The output terminal 105 outputs the output signal F produced by the arithmetic circuit 104.

Configuration of Correlation Component Removal Filter Circuit 102

Figure 2:
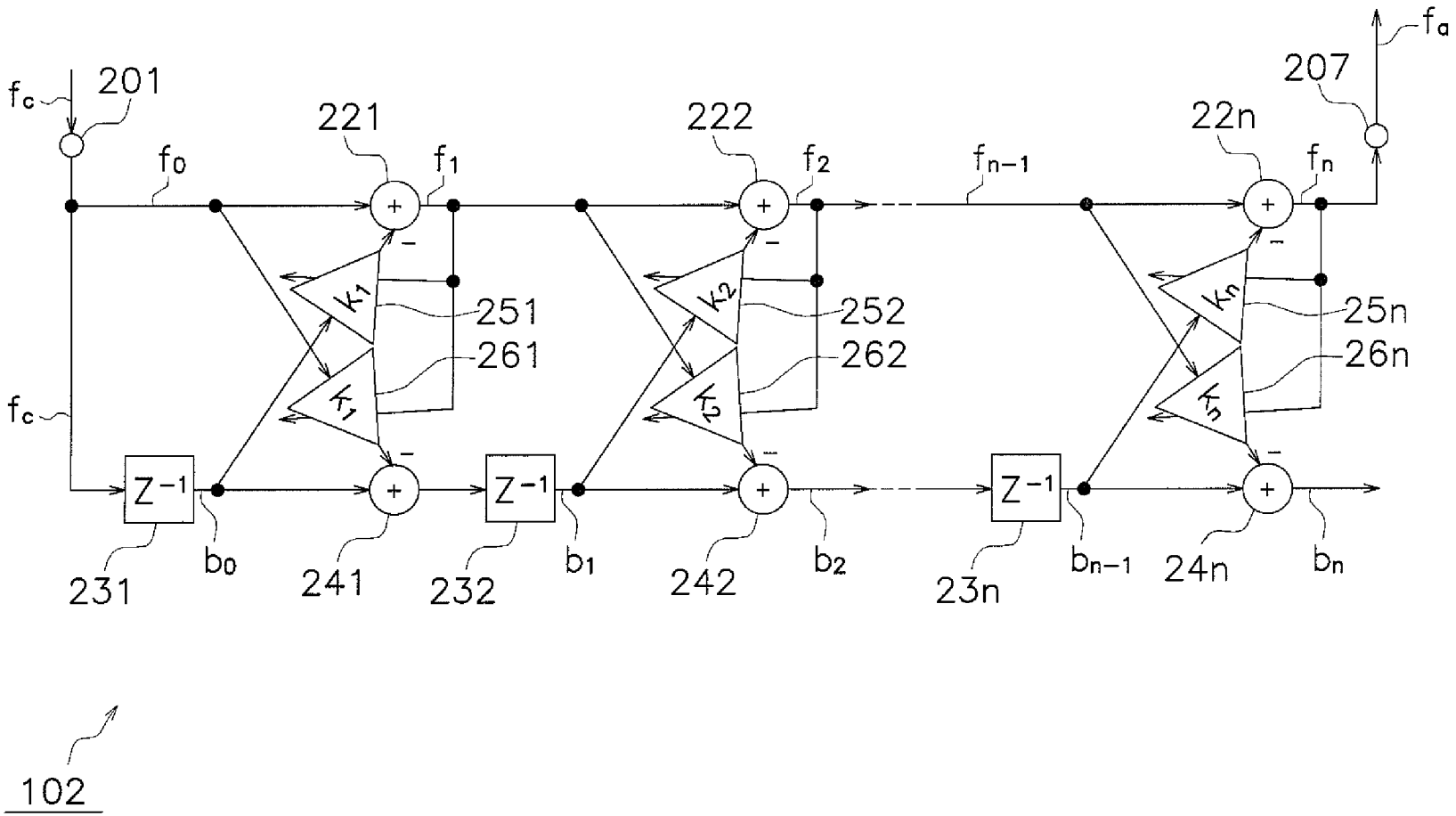
FIG. 2 is a block diagram of the configuration of the correlation component removal filter circuit pertaining to the first embodiment.

FIG. 2 is a block diagram of the configuration of the correlation component removal filter circuit 102 pertaining to an embodiment. The correlation component removal filter circuit 102 comprises an input terminal 201, feedforward filter subtraction circuits 221 to 22*n*, delay circuits 231 to 23*n*, feedback filter subtraction circuits 241 to 24*n*, feedforward filter coefficient multiplication circuits 251 to 25*n*, feedback filter coefficient multiplication circuits 261 to 26*n*, and an output terminal 207. With this correlation component removal filter circuit 102 (a lattice-type filter circuit), signal components having autocorrelation out of the voice signals that come before and after in time can be converged at high speed.

(1) Input Terminal 201

The input terminal 201 outputs the voice signal $f_0$ inputted from the input terminal 101 to the feedforward filter subtraction circuit 221, the delay circuit 231, and the feedback filter coefficient multiplication circuit 261.

(2) Feedforward Filter Subtraction Circuits 221 to 22*n*

The feedforward filter subtraction circuits 221 to 22*n* are constituted by n number of feedforward filter subtraction circuits from a first level to an n-th (n is a natural number). The feedforward filter subtraction circuits 221 to 22*n* calculate the inputted signals according to the following formula (1).

$$f_i = f_{i-1} - k_{i,j} \times b_{i-1} \quad (1)$$

In Formula 1, the variable i indicates the number of levels of the feedforward filter subtraction circuits 221 to 22*n*, and the variable j indicates the clock time of the signals inputted to the feedforward filter subtraction circuits 221 to 22*n*. The variable j indicating clock time advances in a unit time that is the inverse of the sampling period of the voice signal $f_0$. The unit time is 1/44,100 (second) for a music CD, and is 1/8000 (second) for a telephone line. Also, $k_{i,j}$ in Formula 1 is a filter coefficient at the time j of the i-th level, and $b_{i-1}$ is a feedback predicted error signal at the i−1-th level.

First, the feedforward filter subtraction circuit 221 of the first level produces a feedforward predicted error signal $f_1$ by calculating the voice signal $f_0$ using 1 as the variable i in Formula 1. The feedforward filter subtraction circuit 221 outputs the feedforward predicted error signal $f_1$ to the feedforward filter subtraction circuit 222, the feedforward filter coefficient multiplication circuit 251, and the feedback filter coefficient multiplication circuit 262.

Next, the feedforward filter subtraction circuit 222 of the second level produces a feedforward predicted error signal $f_2$ by calculating the feedforward predicted error signal $f_1$ using 2 as the variable i in Formula 1. The feedforward filter subtraction circuit 222 outputs the feedforward predicted error signal $f_2$ to the next level.

After the above processing has been repeated up to the (n−1)-th level, a feedforward predicted error signal $f_{n-1}$ is inputted to the feedforward filter subtraction circuit 22*n* of the n-th level. The feedforward filter subtraction circuit 22*n* of the n-th level produces a feedforward predicted error signal $f_n$ by calculating the feedforward predicted error signal $f_{n-1}$ using n as the variable i in Formula 1. In this embodiment, the amplitude of the feedforward predicted error signal $f_n$ approaches "0" the higher is the correlation to the sine wave of the voice signal $f_0$, and greatly diverges the lower is the correlation to the sine wave of the voice signal $f_0$. Here, of the voice signals, vowels will have the highest correlation to the sine wave, and consonants will have the lowest correlation to the sine wave. Therefore, the amplitude of the feedforward predicted error signal $f_n$ is smaller when the voice signal $f_0$ is a vowel, and is larger when the voice signal $f_0$ is a consonant. This feedforward predicted error signal $f_n$ is outputted from the feedforward filter subtraction circuit 22*n* to the output terminal 207 and the feedback filter coefficient multiplication circuit 26*n*. The output terminal 207 pertaining to this embodiment outputs the feedforward predicted error signal $f_n$ as the filter output signal fa to the multiplication circuit 103.

(3) Delay Circuits 231 to 23*n*

The delay circuits 231 to 23*n* are constituted by n number of delay circuits from the first level to the n-th level. The delay circuits 231 to 23*n* subject inputted signals to delay processing of the unit time. First, the delay circuit 231 of the first level produces a delay signal $b_0$ by delaying the voice signal $f_0$ by the unit time. The delay circuit 232 of the second level subjects the feedback predicted error signal $b_1$ produced by the feedback filter subtraction circuit 241 (discussed below) to delay processing by the unit time. After this processing has been repeated, the delay circuit 23*n* of the n-th level subjects a feedback predicted error signal $b_{n-1}$ to delay processing by the unit time. The delay circuits 231 to 23*n* output the signals that have undergone delay processing to the feedback filter subtraction circuits 241 to 24*n* and the feedforward filter coefficient multiplication circuits 251 to 25*n*.

(4) Feedback Filter Subtraction Circuits 241 to 24*n*

The feedback filter subtraction circuits 241 to 24*n* are constituted by n number of feedback filter subtraction circuits from the first level to the n-th level. The feedforward filter subtraction circuits 221 to 22*n* calculate the inputted signals according to the following formula (2).

$$b_i = b_{i-1} - k_{i,j} \times f_{i-1} \quad (2)$$

In Formula 2, $k_{i,j}$ is the filter coefficient at a time j at the i-th level, and $f_{i-1}$ is a feedforward predicted error signal at the i−1-th level.

First, the feedback filter subtraction circuit 241 of the first level produces the feedback predicted error signal $b_1$ by calculating the delay signal $b_0$ using 1 as the variable i in Formula 2. The feedback filter subtraction circuit 241 outputs the feedback predicted error signal $b_1$ to the delay circuit 232.

Next, the feedback filter subtraction circuit 242 of the second level produces a feedback predicted error signal $b_2$ by calculating the feedback predicted error signal $b_1$ that has undergone delay processing of the unit time by the delay circuit 232, using 2 as the variable i in Formula 2.

After the above processing has been repeated up to the (n−1)-th level, a feedback predicted error signal $b_{n-1}$ that has undergone delay processing of the unit time by the delay circuit 23*n* is inputted to the feedback filter subtraction circuit 24*n* of the n-th level. The feedback filter subtraction circuit 24*n* of the n-th level produces a feedback predicted error signal $b_n$ by calculating feedback predicted error signal $b_{n-1}$ using n as the variable i in Formula 2.

(5) Feedforward Filter Coefficient Multiplication Circuits 251 to 25*n*

The feedforward filter coefficient multiplication circuits 251 to 25*n* are constituted by n number of feedforward filter coefficient multiplication circuits from the first level to the n-th level. The feedforward filter coefficient multiplication circuits 251 to 25*n* multiply the signals inputted from the delay circuits 231 to 23*n* by the filter coefficient $k_{i,j}$ and output the products to the feedforward filter subtraction circuits 221 to 22*n*.

The feedforward filter coefficient multiplication circuits 251 to 25*n* update the filter coefficient $k_{i,j}$ at each unit time according to the following formula (3). As discussed above, the unit time is 1/44,100 (second) for a music CD, and is 1/8000 (second) for a telephone line.

$$k_{i,j+1} = k_{i,j} + \Delta k_{i,j} = k_{i,j} + \alpha \times f_i / b_{i-1} \quad (3)$$

In Formula 3, $k_{i,j}$ is the filter coefficient at the time j at the i-th level, and $\alpha$ is a constant that determines the rate of convergence at the correlation component removal filter circuit 102 (where $0.0 \leq \alpha \leq 2.0$).

Thus, the feedforward filter coefficient multiplication circuits 251 to 25*n* add to the filter coefficient $k_{i,j}$ the product of multiplying the constant $\alpha$ by the quotient of dividing the feedforward predicted error signal $f_i$ at the i-th level by the feedback predicted error signal $b_{i-1}$ at the i−1-th level, thereby finding the filter coefficient $k_{i,j+1}$ at the time j+1 at the i-th level. Therefore, the difference between the filter coefficient $k_{i,j}$ and the filter coefficient $k_{i,j+1}$ (that is, the amount of correction per unit time) increases in proportion to the feedforward predicted error signal $f_i$. Thus, learning of the filter coefficient k at the feedforward filter coefficient multiplication circuits 251 to 25*n* is executed at every unit time.

The method involved in Formula 3 will now be described.

First, the feedforward predicted error signal $f_i$ at the i-th level is as shown in the following formula (3-1).

$$f_i = f_{i-1} - k_{i,j} \times b_{i-1} \quad (3\text{-}1)$$

In Formula 3-1, i is a lattice-type filter coefficient (1 to n), and j is the clock time.

Next, assuming that the mutual independence of the filter coefficient $k_{i,j}$ is guaranteed, if we use the squared error $f_i^2$ for an evaluation function at the i-th level, the following formulas (3-2 to 3-4) hold when the squared error $f_i^2$ is subjected to partial differentiation (LMS method) with $k_{i,j}$.

$$\partial f_i^2 / \partial k_{i,j} = (\partial f_i^2 / \partial f_i)(\partial f_i / \partial k_{i,j}) = -2 f_i \times b_{i-1} \quad (3\text{-}3)$$

$$k_{i,j+1} = k_{i,j} + \Delta k_{i,j} \quad (3\text{-}3)$$

$$\Delta k_{i,j} = 2 \partial f_i^2 / \partial k_{i,j} = C f_i \times b_{i-1} \quad (3\text{-}4)$$

In Formulas 3-2 to 3-4, $\Delta k_{i,j}$ is a corrections vector, j is the clock time, and C is a constant.

Next, to normalize the constant C, the following formula (3-5) holds by finding the condition under which the filter coefficient $k_{i,j}$ corrected at the time j−1 minimizes the squared error $f_i^2$ at the time j−1.

$$\begin{aligned} f_i^2 &= (f_{i-1} - k_{i,j} \times b_{i-1})^2 \quad (3\text{-}5) \\ &= (f_{i-1} - (k_{i,j} + \Delta k_{i,j-1}) \times b_{i-1})^2 \\ &= (f_{i-1} - (k_{i,j-1} + 2Cf_i \times b_{i-1}) \times b_{i-1})^2 \\ &= (f_{i-1} - k_{i,j-1} \times b_{i-1} - 2Cf_i \times b_{i-1}^2)^2 \\ &= (f_{i-1} - k_{i,j-1} \times b_{i-1} - 2Cb_{i-1}^2 (f_{i-1} - k_{i,j} \times b_{i-1}))^2 \\ &= ((f_{i-1} - k_{i,j-1} \times b_{i-1}) \times (1 - 2Cb_{i-1}^2))^2 \end{aligned}$$

Therefore, from Formula 3-5, the condition for minimizing (0) the squared error $f_i^2$ is as shown in the following formula (3-6).

$$1 - 2Cb_{i-1}^2 = 0 \quad (3\text{-}6)$$

From Formula 3-6, the condition for the constant C is as shown in the following formula (3-7).

$$C = 1/(2b_{i-1}^2) \quad (3\text{-}7)$$

As a result, the following formula (3-8) holds, and obtain the above-mentioned Formula 3.

$$\Delta k_{i,j} = 2Cf_i \times b_{i-1} = 2f_i \times b_{i-1} / (2b_{i-1}^2) = f_i / b_{i-1} \quad (3\text{-}8)$$

$$k_{i,j+1} = k_{i,j} + \Delta k_{i,j} = k_{i,j} + \alpha \times f_i / b_{i-1} \quad (3)$$

(6) Feedback Filter Coefficient Multiplication Circuits 261 to 26*n*

The feedback filter coefficient multiplication circuits 261 to 26*n* are constituted by n number of feedback filter coefficient multiplication circuits from the first level to the n-th level. The feedback filter coefficient multiplication circuits 261 to 26*n* multiply the inputted signals by the filter coefficient $k_{i,j}$ and output the products to the feedback filter subtraction circuits 241 to 24*n*.

The feedback filter coefficient multiplication circuits 261 to 26*n* update the filter coefficient $k_{i,j}$ at every unit time according to the following formula (4). As mentioned above, the unit time is 1/44,100 (second) for a music CD, and is 1/8000 (second) for a telephone line.

$$k_{i,j+1} = k_{i,j} + \Delta k_{i,j} = k_{i,j} + \alpha \times f_i / f_{i-1} \quad (4)$$

In Formula 4, $k_{i,j}$ is the filter coefficient at the time j at the i-th level, and $\alpha$ is a constant that determines the rate of convergence (where $0.0 \leq \alpha \leq 2.0$).

Thus, the feedback filter coefficient multiplication circuits 261 to 26*n* find the filter coefficient $k_{i,j+1}$ at the time j+1 at the i-th level by adding the filter coefficient $k_{i,j}$ to the product of multiplying a constant $\alpha$ by the quotient of dividing the feedforward predicted error signal $f_i$ at the i-th level by the feedforward predicted error signal $f_{i-1}$ at the i−1-th level. Therefore, the difference between the filter coefficient $k_{i,j}$ and the filter coefficient $k_{i,j+1}$ (that is, the amount of correction per unit time) increases in proportion to the feedforward predicted error signal $f_i$. Thus, learning of the filter coefficient k at the feedback filter coefficient multiplication circuits 261 to 26*n* is executed at every unit time.

The method involved in Formula 4 is the same as that involved in Formula 3 discussed above.

Action and Effect (1) With the voice emphasis device 100 pertaining to the first embodiment, the extracted signal fb obtained by multiplying a gain coefficient by the filter output signal fa with no periodicity (that is, the feedforward predicted error signal $f_n$) extracted by removing the signal component having autocorrelation from the voice signal $f_0$ is added to the voice signal $f_0$.

Therefore, the level of signals with no periodicity, such as a consonant, as opposed to signals with periodicity, such as a vowel, can be increased in the output signal F. Accordingly, the clarity of a voice signal can be improved by compensating the hearing of a person with diminished hearing in the high ranges, or by compensating the signal level of consonants that tend to be masked by vowels.

Also, with the voice emphasis device 100 pertaining to the first embodiment, the feedforward filter coefficient multiplication circuits 251 to 25*n* and the feedback filter coefficient multiplication circuits 261 to 26*n* update the filter coefficient $k_{i,j}$ at every unit time (that is, the inverse of the sampling frequency).

Therefore, it can be predicted extremely rapidly whether a signal inputted to the correlation component removal filter circuit 102 is a signal with periodicity, such as a vowel, or a signal with no periodicity, such as a consonant. Accordingly, consonants can be extracted with good accuracy from the voice signal $f_0$.

Figure 3:
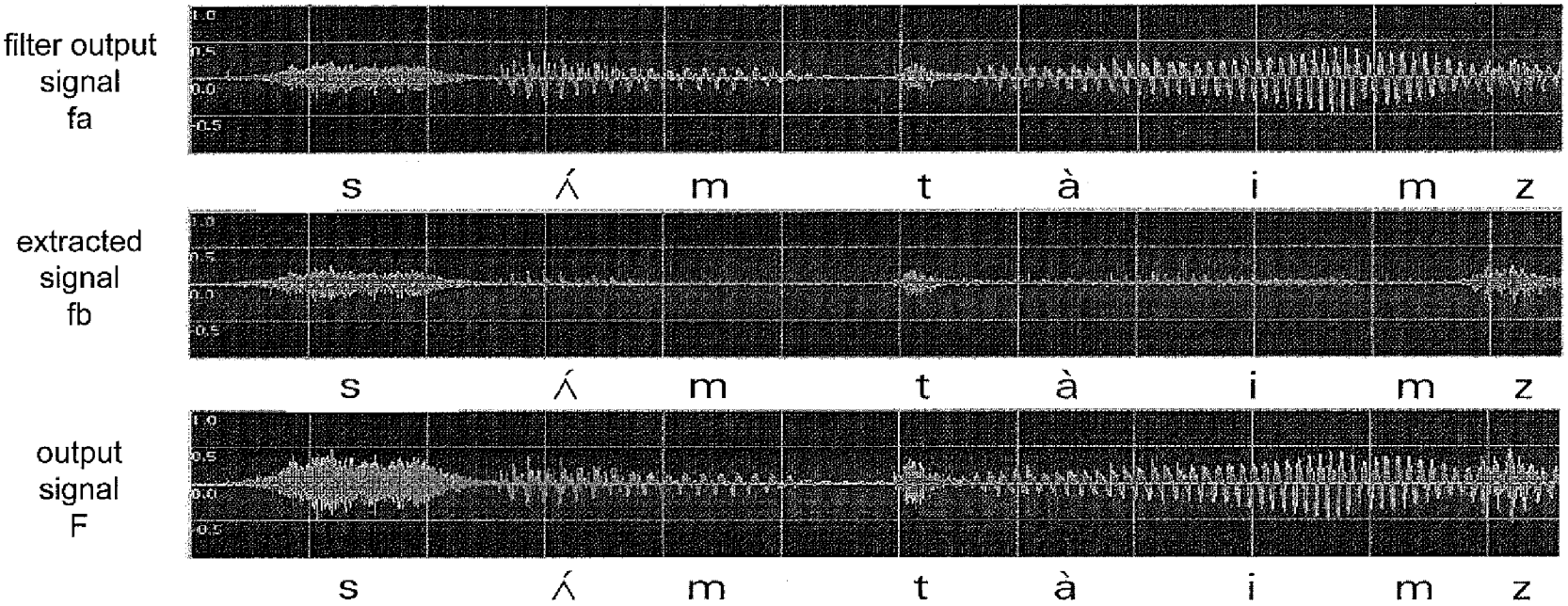
FIG. 3 is a graph of the signal waveforms of the voice signal, extracted signal, and output signal in the voice emphasis device pertaining to the first embodiment.

(2) The effect of the voice emphasis device 100 will now be described through reference to the drawings. FIG. 3 is a graph of the signal waveforms of the voice signal $f_0$, the extracted signal fb, and the output signal F corresponding to "sometimes." The sampling frequency of "sometimes" in FIG. 3 is 44.1 kHz, and the gain coefficient of the multiplication circuit 103 is 1.0. As shown in FIG. 3, with the extracted signal fb, the sounds "a," "m," and "i," which are vowels having autocorrelation among the voice signal $f_0$, are eliminated, and the sounds "s," "t," and "z," which are consonants corresponding to fricatives and plosives, can be extracted. As a result, with the output signal F, it can be confirmed that the consonants are emphasized as compared to the voice signal $f_0$.

Second Embodiment

Next, the voice emphasis device pertaining to a second embodiment will be described through reference to the drawings. The difference between the first and second embodiments is that the filter coefficient $k_{i,j}$ is set to "0" when the feedforward predicted error signal $f_n$ is greater than the voice signal $f_0$ in a correlation component removal filter circuit 102*a*. The following description will focus on the differences from the first embodiment.

Figure 4:
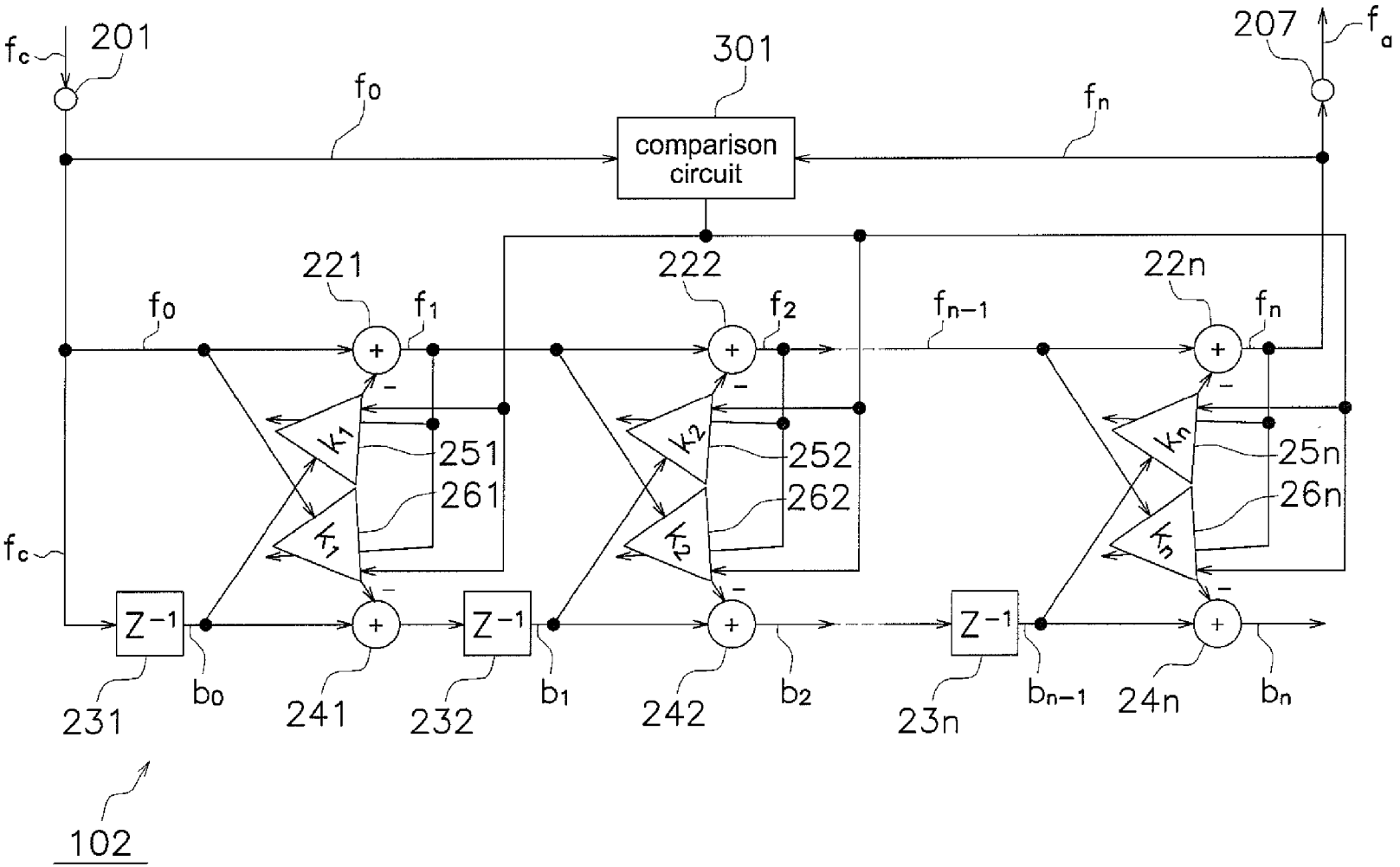
FIG. 4 is a block diagram of the configuration of the correlation component removal filter circuit pertaining to a second embodiment.

FIG. 4 is a block diagram of the configuration of the correlation component removal filter circuit 102*a* pertaining to the second embodiment. The correlation component removal filter circuit 102*a* has a comparison circuit 301.

The comparison circuit 301 compares the amplitude of the voice signal $f_0$ inputted from the input terminal 201 with the amplitude of the feedforward predicted error signal $f_n$ at the n-th level. The comparison circuit 301 directs the feedforward filter coefficient multiplication circuits 251 to 25*n* and the feedback filter coefficient multiplication circuits 261 to 26*n* to set the filter coefficient $k_{i,j}$ (where i=1 to n) to "0" when the amplitude of the feedforward predicted error signal $f_n$ is greater than the amplitude of the voice signal $f_0$. In response to this, the feedforward filter coefficient multiplication circuits 251 to 25*n* and the feedback filter coefficient multiplication circuits 261 to 26*n* set the filter coefficient $k_{i,j}$ to "0."

Action and Effect

With the correlation component removal filter circuit 102*a* pertaining to the second embodiment, the feedforward filter coefficient multiplication circuits 251 to 25*n* and the feedback filter coefficient multiplication circuits 261 to 26*n* set the filter coefficient $k_{i,j}$ to "0" when the amplitude of the predicted error signal $f_n$ is greater than the amplitude of the voice signal $f_0$.

Here, "the amplitude of the predicted error signal $f_n$ is greater than the amplitude of the voice signal $f_0$" means that the voice signal $f_0$ has not been converged by the correlation component removal filter circuit 102*a*. Therefore, in this case there is a high probability that a voice signal $f_0$ that has passed through the correlation component removal filter circuit 102*a* is a consonant. In view of this, setting the filter coefficient $k_{i,j}$ to "0" will prevent the divergence of the filter coefficient $k_{i,j}$ caused by continuing to input an uncorrelated signal to the lattice-type filter circuit, and will allow the correlation component removal filter circuit 102*a* to operate stably.

Third Embodiment

Next, the voice emphasis device pertaining to a third embodiment will be described through reference to the drawings. The difference between the second and third embodiments is that the voice signal $f_0$ is left as the filter output signal fa when the amplitude of the feedforward predicted error signal $f_n$ is greater than the amplitude of the voice signal $f_0$ at a high incidence. The following description will focus on the differences from the second embodiment.

Figure 5:
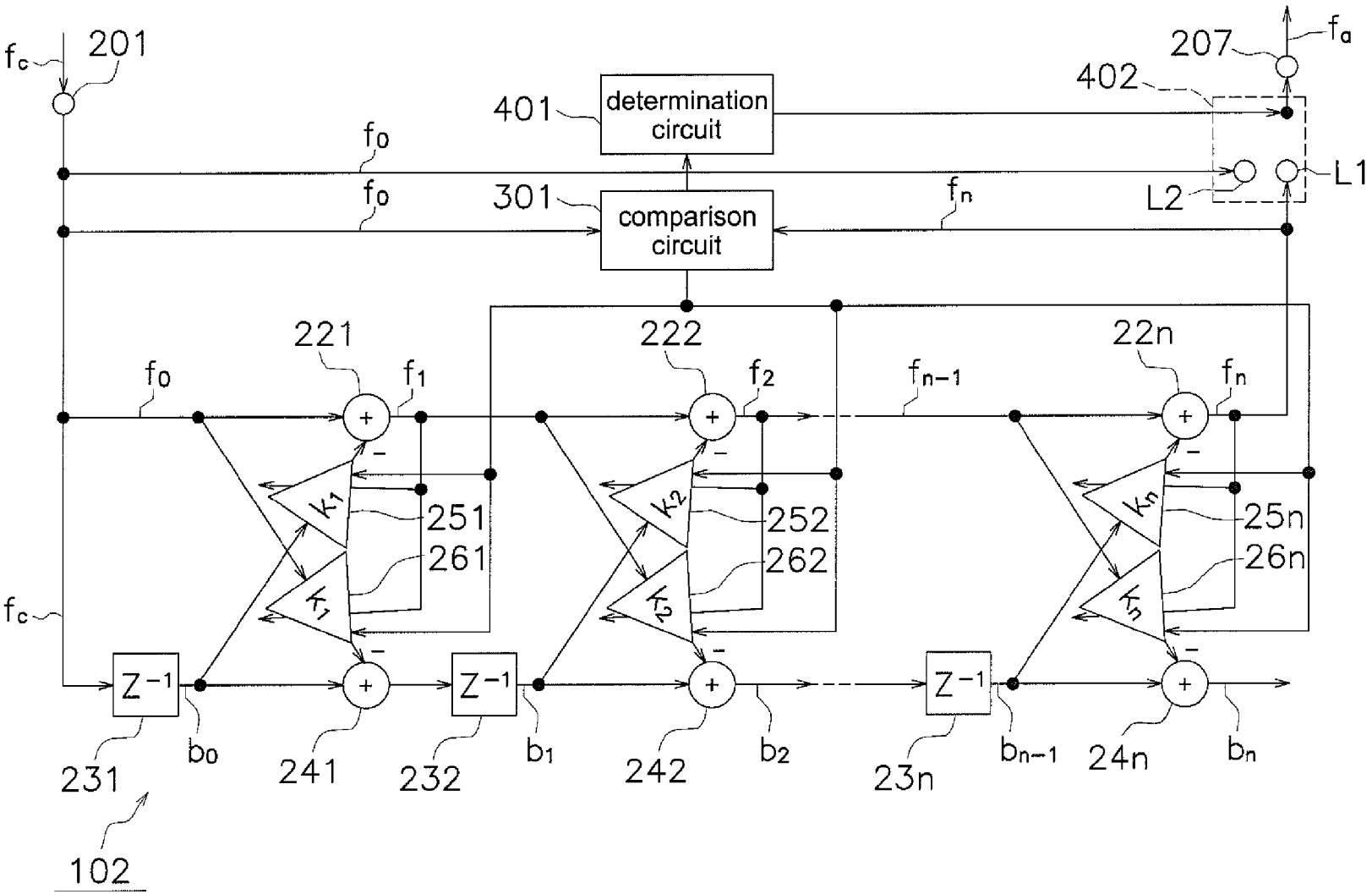
FIG. 5 is a block diagram of the configuration of the correlation component removal filter circuit pertaining to a third embodiment.

FIG. 5 is a block diagram of the configuration of the correlation component removal filter circuit 102*b* pertaining to the third embodiment. The correlation component removal filter circuit 102*b* comprises a determination circuit 401 and a switching circuit 402.

The comparison circuit 301 notifies the determination circuit 401 of its comparison result every time it compares whether or not the amplitude of the feedforward predicted error signal $f_n$ is greater than the amplitude of the voice signal $f_0$.

The determination circuit 401 calculates the incidence at which the voice signal $f_0$ is not considered to be converged by the correlation component removal filter circuit 102*b*, based on the comparison result of the comparison circuit 301. The determination circuit 401 determines whether or not the incidence at which the voice signal $f_0$ is not considered to be converged is at least a specific value. The "incidence at which the voice signal $f_0$ is not considered to be converged" is indicated, for example, by the ratio of the number of times the feedforward predicted error signal $f_n$ is determined to be greater than the voice signal $f_0$, to the total number of determination results, or by the number of times the feedforward predicted error signal $f_n$ is determined to be greater than the voice signal $f_0$ within a specific length of time.

If the incidence is not at least the specific value, the determination circuit 401 switches the switching circuit 402 to a first terminal L1 side, thereby interposing a lattice-type filter between the input terminal 201 and the output terminal 207. Consequently, the feedforward predicted error signal $f_n$ at the n-th level is inputted to the output terminal 207, and the feedforward predicted error signal $f_n$ is outputted from the output terminal 207 as the filter output signal fa.

On the other hand, if the incidence is at least the specific value, the determination circuit 401 switches the switching circuit 402 to a second terminal L2 side, thereby directly linking the input terminal 201 and the output terminal 207. Consequently, the voice signal $f_0$ is inputted to the output terminal 207, and the voice signal $f_0$ itself is outputted from the output terminal 207 as the filter output signal fa.

Action and Effect

If the incidence at which the voice signal $f_0$ is not considered to have been converged is at least a specific value, the correlation component removal filter circuit 102*b* pertaining to the third embodiment outputs the voice signal $f_0$ itself as the filter output signal fa.

Therefore, if there is a high probability that the voice signal $f_0$ that has passed through the correlation component removal filter circuit 102*a* is a consonant, it can be outputted without adding any processing to the voice signal $f_0$. Accordingly, the distortion of consonants by a lattice-type filter (the feedforward filter subtraction circuits 221 to 22*n*, the feedback filter subtraction circuits 241 to 24*n*, etc.) can be suppressed.

Fourth Embodiment

Next, the voice emphasis device 100A pertaining to a fourth embodiment will be described through reference to the drawings. The difference between the first and fourth embodiments is that a "voice signal processor" does not combine the output of the correlation component removal filter circuit 102 with the voice signal $f_0$. The following description will focus on the differences from the first embodiment.

Figure 6:
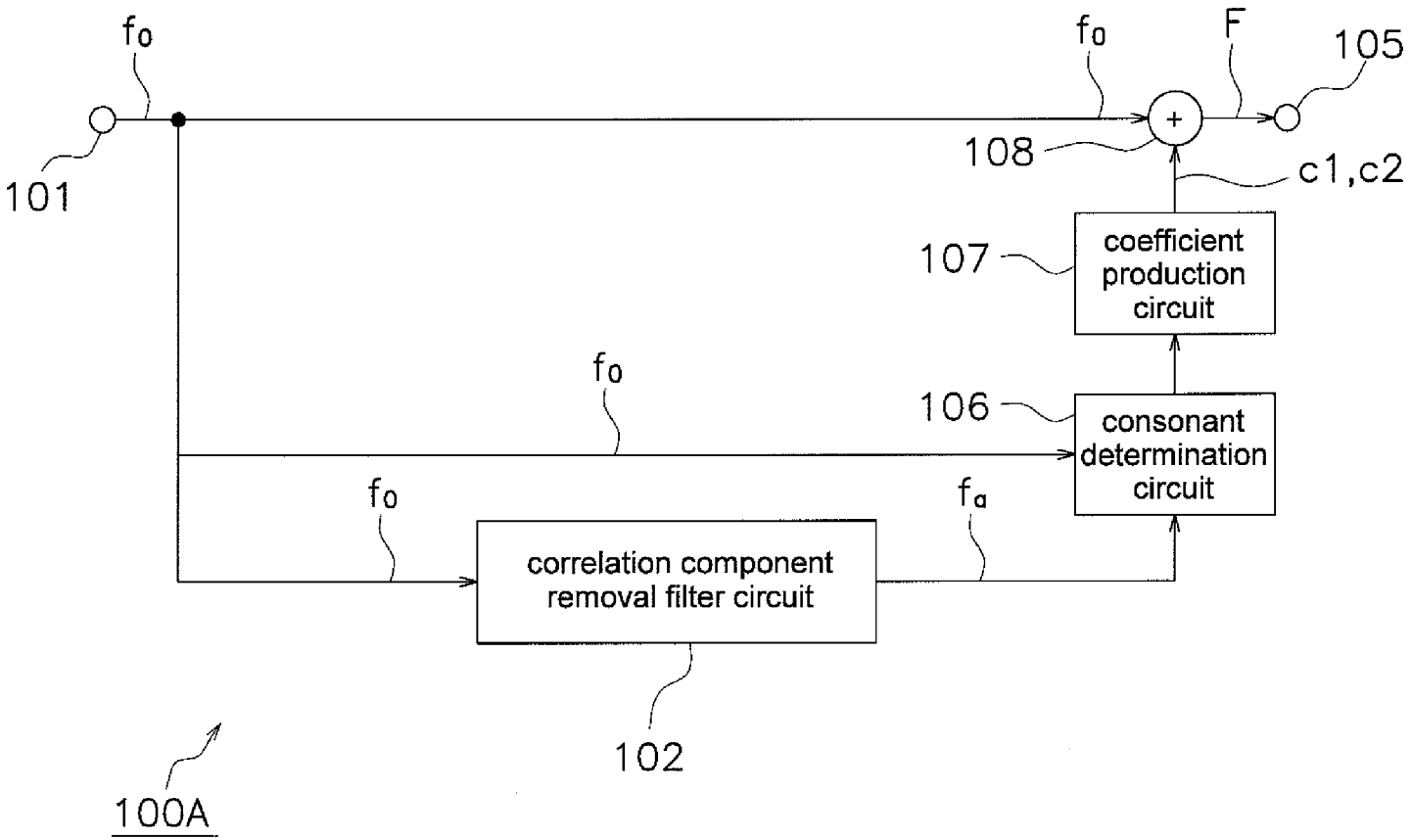
FIG. 6 is a block diagram of the configuration of the voice emphasis device pertaining to a fourth embodiment.

FIG. 6 is a block diagram of the configuration of the voice emphasis device 100A pertaining to the fourth embodiment. The voice emphasis device 100A comprises a consonant determination circuit 106, a coefficient production circuit 107, and an operation circuit 108 instead of the multiplication circuit 103 and the arithmetic circuit 104 pertaining to the first embodiment.

The consonant determination circuit 106 compares the amplitude of the voice signal $f_0$ with the amplitude of the filter output signal fa, and determines whether or not the voice signal $f_0$ is a consonant. More specifically, the consonant determination circuit 106 makes a determination of "not a consonant" (that is, it is a vowel) if the amplitude of the filter output signal fa is at or below the amplitude of the voice signal $f_0$, and makes a determination of "is a consonant" if the amplitude of the filter output signal fa is greater than the amplitude of the voice signal $f_0$. The consonant determination circuit 106 notifies the coefficient production circuit 107 of the determination result.

Upon receipt of a notification of "is a consonant" from the consonant determination circuit 106, the coefficient production circuit 107 notifies the operation circuit 108 of a first filter coefficient c1 (an example of a specific gain coefficient). The first gain coefficient c1 may be any numerical value greater than 1 (such as 2, 3, etc.). Upon receipt of "is not a consonant" from the consonant determination circuit 106, the coefficient production circuit 107 notifies the operation circuit 108 of a second gain coefficient c2. The second gain coefficient c2 is a numerical value that is greater than 0 and less than the first gain coefficient c1 (such as 1, etc.).

The operation circuit 108 multiplies the first gain coefficient c1 or the second gain coefficient c2 sent from the coefficient production circuit 107 by the voice signal $f_0$. Consequently, if the voice signal $f_0$ is a consonant, an output signal F is produced in which the amplitude of the voice signal $f_0$ has been increased, and if the voice signal $f_0$ is not a consonant, an output signal F is produced in which the amplitude of the voice signal $f_0$ has not been increased.

The consonant determination circuit 106, the coefficient production circuit 107, and the operation circuit 108 constitute a "voice signal processor" that executes signal processing of the voice signal $f_0$ based on the output of the correlation component removal filter circuit 102 (specifically, the filter output signal fa).

Action and Effect

The voice emphasis device 100A pertaining to the fourth embodiment comprises the consonant determination circuit 106, the coefficient production circuit 107, and the operation circuit 108. The operation circuit 108 multiplies the voice signal $f_0$ by the first gain coefficient c1 when the voice signal $f_0$ is determined to be a consonant.

Therefore, if the voice signal $f_0$ is a consonant, the voice emphasis device 100A can increase the amplitude of the voice signal $f_0$ without combining the filter output signal fa and the voice signal $f_0$. Accordingly, the effect on the output signal F by distortion of the filter output signal fa that may be caused by the correlation component removal filter circuit 102 can be suppressed.

Other Embodiments

The present invention was described by the above embodiments, but the text and drawings that form part of this disclosure should not be construed as limiting this invention. Various alternative embodiments, working examples, and application techniques will be clear to a person skilled in the art from this disclosure.

(A) In the above embodiments, a lattice-type filter circuit is used as the correlation component removal filter circuit 102, but this is not the only option. A FIR filter circuit or an IIR filter circuit can be used instead as the correlation component removal filter circuit 102. In this case, it will be possible to reduce the amount of calculation.

(B) In the above embodiment, the voice emphasis device 100 increased voice clarity by raising the amplitude of consonants among the voice signal $f_0$, but this is not the only option.

The voice emphasis device 100 can instead increase voice clarity by lowering the amplitude of noise among the voice signal $f_0$. More specifically, The arithmetic circuit 104 may produce the output signal F by subtracting the extracted signal fb from the voice signal $f_0$. In this case, the amplitude of signals with no periodicity, such as noise, as opposed to signals with periodicity, such as vowels, can be lowered in the output signal F. Therefore, noise can be eliminated from the voice signal $f_0$, which means that voice clarity can be improved. In this case, consonants are eliminated along with noise, but this can be an effective approach when there is a large noise component.

Also, with the voice emphasis device 100, voice clarity can be improved by lowering the amplitude of percussive instrument sounds among the voice signal $f_0$, or by raising the amplitude of percussive instrument sounds among the voice signal $f_0$. More specifically, if stringed instrument sounds and percussive instrument sounds are mixed together in a voice signal, the arithmetic circuit 104 can suppress just the percussive instrument sounds with no periodicity by subtracting the extracted signal fb from the voice signal $f_0$. Meanwhile, if stringed instrument sounds and percussive instrument sounds are mixed together in a voice signal, the arithmetic circuit 104 can emphasize just the percussive instrument sounds with no periodicity by adding the extracted signal fb to the voice signal $f_0$.

(C) In the third embodiment above, just as in the second embodiment, the comparison circuit 301 set the filter coefficient $k_{i,j}$ to "0" when the amplitude of the feedforward predicted error signal $f_n$ was greater than the amplitude of the voice signal $f_0$, but this is not the only option. In the third embodiment, the comparison circuit 301 need not direct the feedforward filter coefficient multiplication circuits 251 to 25*n* and the feedback filter coefficient multiplication circuits 261 to 26*n* to set the filter coefficient $k_{i,j}$ to "0," as long as the determination circuit 401 is notified of the result of comparing whether or not the amplitude of the feedforward predicted error signal $f_n$ is greater than the amplitude of the voice signal $f_0$.

What is claimed is:

1. A voice emphasis device comprising:

a correlation component removal filter circuit configured to remove a correlation component from a voice signal produced at a specific sampling frequency; and a voice signal processor configured to execute signal processing on the voice signal based on an output of the correlation component removal filter circuit, the correlation component removal filter circuit being a lattice-type filter circuit in which a feedforward filter and a feedback filter are combined, and the feedforward filter and the feedback filter configured to update a filter coefficient on the basis of the specific sampling frequency according to the following formula:

$$k_{i,j+1}=k_{i,j}+\alpha\times f_i/b_{i-1}$$

(where $k_{i,j}$ is a filter coefficient at a i-th level of the lattice-type filter circuit at a time j, $k_{i,j+1}$ is a filter coefficient at the i-th level of the lattice-type filter circuit at a time j+1, i is a natural number from 1 to n, n is a number of levels of the lattice-type filter circuit, $\alpha$ is a constant ($0.0 \leq \alpha \leq 2.0$), fi is a feedforward predicted error signal at the i-th level of the lattice-type filter circuit, and $b_{i-1}$ is a feedback predicted error signal at the i-th level of the lattice-type filter circuit).

2. The voice emphasis device according to claim 1, wherein the correlation component removal filter circuit is configured to set the filter coefficient to zero when an amplitude of the feedforward predicted error signal at an n-th level is greater than an amplitude of the voice signal.

3. The voice emphasis device according to claim 1, wherein the correlation component removal filter circuit is configured to switch the output to the voice signal when an incidence at which an amplitude of the feedforward predicted error signal at an n-th level is greater than an amplitude of the voice signal is equal to or more than a specific value.

4. The voice emphasis device according to claim 1, wherein the voice signal processor has a multiplication circuit and an arithmetic circuit, the multiplication circuit configured to produce an extracted signal by multiplying a specific gain coefficient by the output of the correlation component removal filter circuit, the arithmetic circuit configured to add the extracted signal to the voice signal or subtract the extracted signal from the voice signal.

5. The voice emphasis device according to claim 1, wherein the voice signal processor has a consonant determination circuit and an arithmetic circuit, the consonant determination circuit configured to determine whether or not the voice signal is a consonant based on the output of the correlation component removal filter circuit, the arithmetic circuit configured to multiply a specific gain coefficient by the voice signal when the consonant determination circuit has determined the voice signal to be a consonant.

* * * * *